US008932014B2

(12) United States Patent
Zhao et al.

(10) Patent No.: US 8,932,014 B2
(45) Date of Patent: Jan. 13, 2015

(54) FAN ASSEMBLY

(75) Inventors: Jin-Long Zhao, Shenzhen (CN); Dung-Chang Yeh, New Taipei (TW)

(73) Assignees: Fu Zhun Precision Industry (Shen Zhen) Co., Ltd., Shenzhen (CN); Foxconn Technology Co., Ltd., New Taipei (TW)

( * ) Notice: Subject to any disclaimer, the term of this patent is extended or adjusted under 35 U.S.C. 154(b) by 590 days.

(21) Appl. No.: 13/241,174

(22) Filed: Sep. 22, 2011

(65) Prior Publication Data

US 2013/0004293 A1 Jan. 3, 2013

(30) Foreign Application Priority Data

Jun. 29, 2011 (CN) ..... 2011 1 0178990

(51) Int. Cl.
*F04D 29/60* (2006.01)
*F04D 19/00* (2006.01)
*F04D 25/06* (2006.01)

(52) U.S. Cl.
CPC ..... *F04D 19/007* (2013.01); *F04D 25/0613* (2013.01)
USPC ..... 415/213.1; 416/198 R

(58) Field of Classification Search
USPC ..... 415/66, 68, 213.1, 214.1; 416/198 R; 361/678, 695
See application file for complete search history.

(56) References Cited

U.S. PATENT DOCUMENTS

| | | | | |
|---|---|---|---|---|
| 6,612,817 | B2 * | 9/2003 | Lin et al. | 417/423.5 |
| 7,156,611 | B2 * | 1/2007 | Oosawa et al. | 415/68 |
| 7,654,792 | B2 * | 2/2010 | Kikuichi et al. | 415/68 |
| 8,123,461 | B2 * | 2/2012 | Yoshida et al. | 415/68 |
| 2009/0022587 | A1 * | 1/2009 | Yoshida et al. | 415/213.1 |
| 2009/0246015 | A1 * | 10/2009 | Hsu | 415/213.1 |
| 2010/0329859 | A1 * | 12/2010 | Chen et al. | 415/198.1 |

* cited by examiner

*Primary Examiner* — Igor Kershteyn
*Assistant Examiner* — Aaron R Eastman
(74) *Attorney, Agent, or Firm* — Novak Druce Connolly Bove + Quigg LLP

(57) ABSTRACT

A fan assembly includes a first fan and a second fan stacked together. Each of the first fan and the second fan includes a frame and a supporting base received in the frame. Several extending portions extend from a bottom of the frame of the first fan. A buckling block is formed on an inner side face of each of the extending portions. Several receiving portions are formed at a top of the frame of the second fan corresponding to the extending portions, respectively. A positioning groove is defined in each of the receiving portions. The buckling blocks are engagingly received in the positioning grooves.

10 Claims, 5 Drawing Sheets

FAN ASSEMBLY

BACKGROUND

1. Technical Field

The disclosure relates to fans, and particularly to a fan assembly constructed with two fans.

2. Description of Related Art

With development in computer technology, electronic devices operate at high speed. It is well known that higher speed the electronic devices operate at, more heat they generate. If the heat is not dissipated duly, the stability of the operation of the electronic devices will be impacted adversely. Generally, in order to ensure the electronic device to run normally, a fan is used to dissipate the heat generated by the electronic device. However, a single fan may not provide enough airflow; multiple fans are thus desired to connect with each other for generating a stronger airflow.

Typically, a plurality of screws are used to connect the fans together. However, during assembly, a screwdriver is needed to manipulate the screws, resulting in the assembling process complicated and time-consuming.

What is needed, therefore, is a fan assembly which can overcome the limitations described.

BRIEF DESCRIPTION OF THE DRAWINGS

Many aspects of the present embodiments can be better understood with reference to the following drawings. The components in the drawings are not necessarily drawn to scale, the emphasis instead being placed upon clearly illustrating the principles of the present embodiments. Moreover, in the drawings, like reference numerals designate corresponding parts throughout the several views.

DETAILED DESCRIPTION

Figure 1:
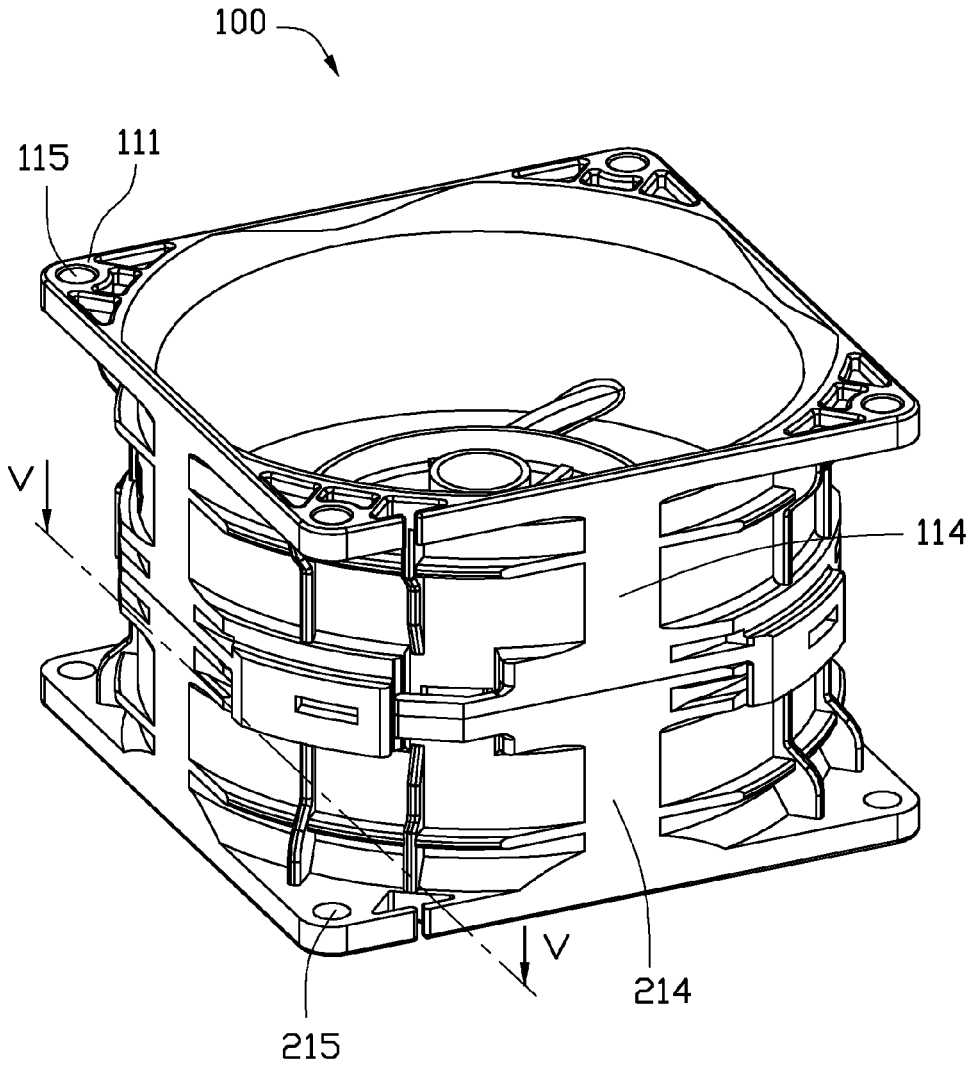
FIG. 1 is an isometric, assembled view of a fan assembly in accordance with one embodiment of the disclosure.
Figure 2:
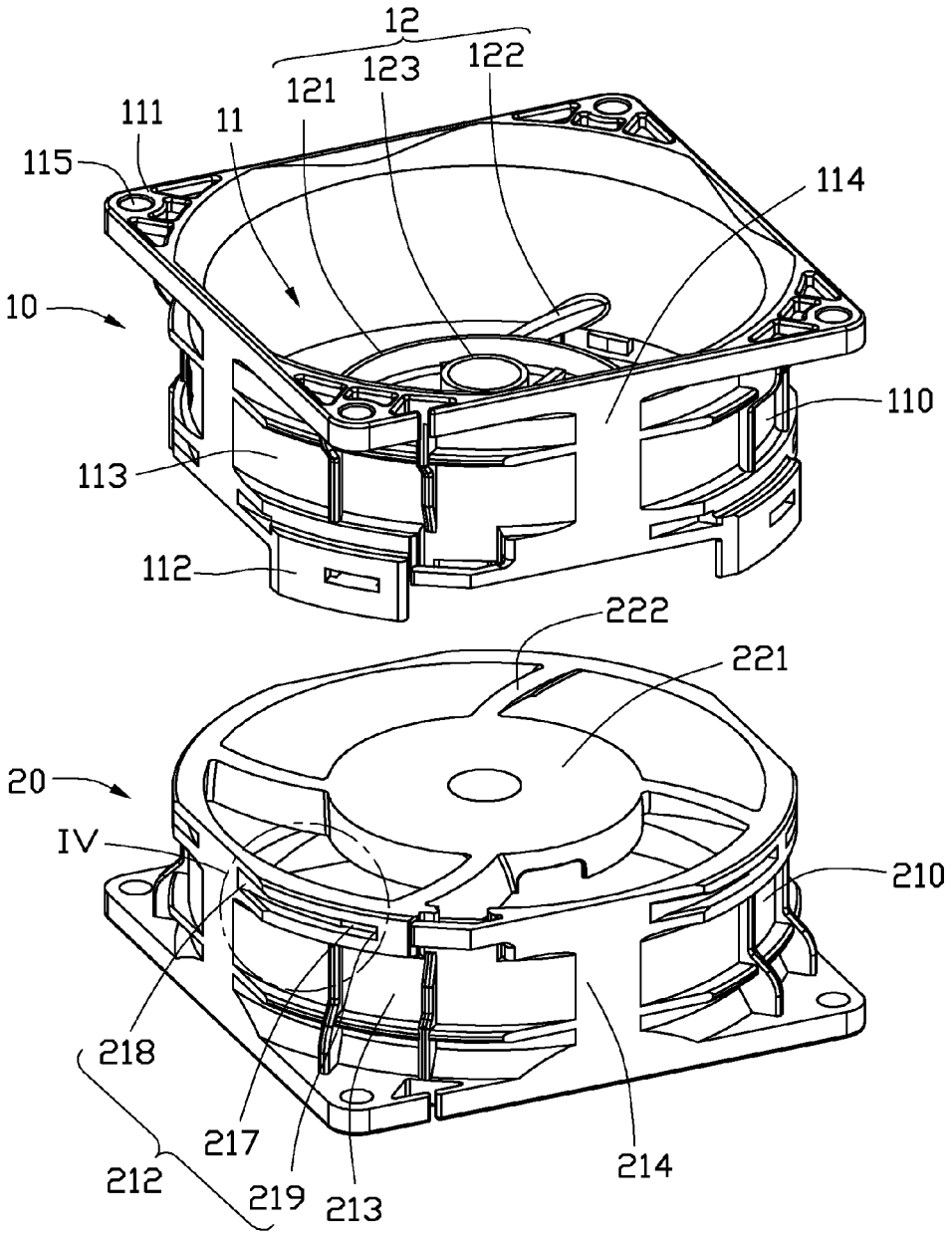
FIG. 2 is an exploded view of the fan assembly of FIG. 1.

Referring to FIG. 1 and FIG. 2, a fan assembly 100 in accordance with an embodiment of the disclosure is shown. The fan assembly 100 includes a first fan 10 and a second fan 20 stacked together.

Figure 3:
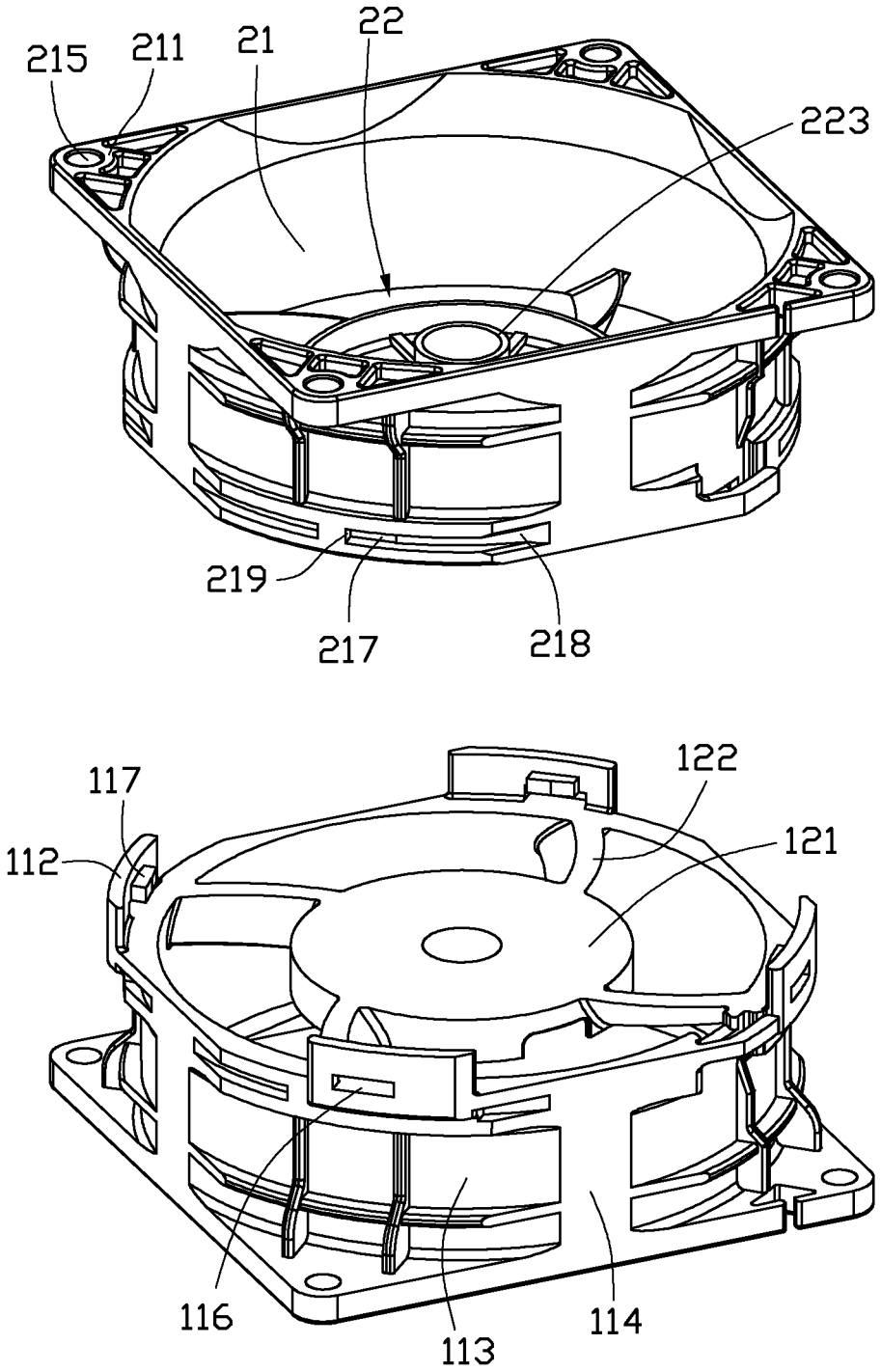
FIG. 3 is an inverted view of the fan assembly of FIG. 2.

Also referring to FIG. 3, the first fan 10 includes an annular first frame 11, and a supporting base 12 received in the first frame 11. The supporting base 12 includes a body 121, four strips 122 extending outwardly and radially from a periphery of the body 121, and an annular wall 123 extending upwardly and vertically from a center of the body 121 for connecting an impeller (not shown). The strips 122 connect an inner face of a bottom of the first frame 11.

The first frame 11 includes an annular first side wall 110, four flanges 111 extending horizontally and outwardly from a top of the first side wall 110, and four curved extending portions 112 extending downwardly from a bottom of the first side wall 110 along a circumferential direction of the first side wall 110. Each flange 111 defines a through hole 115. The extending portions 112 are spaced from each other with a same interval. The first side wall 110 includes four curved portions 113 and four plane portions 114. The curved portions 113 and the plane portions 114 are alternately arranged along the circumferential direction of the first side wall 110. Each extending portion 112 is formed at the bottom of a corresponding curved portion 113. Each extending portion 112 defines a rectangular through hole 116. A buckling block 117 protrudes inwards from an inner side face of each extending portion 112 along a radial direction of the first frame 11.

The second fan 20 includes an annular second frame 21, and a supporting base 22 received in the second frame 21. The supporting base 22 includes a body 221, four strips 222 extending outwardly and radially from a periphery of the body 221, and an annular wall 223 extending downwardly and vertically from a center of the body 221 for connecting an impeller (not shown). The strips 222 connect an inner face of a top of the second frame 21.

Figure 4:
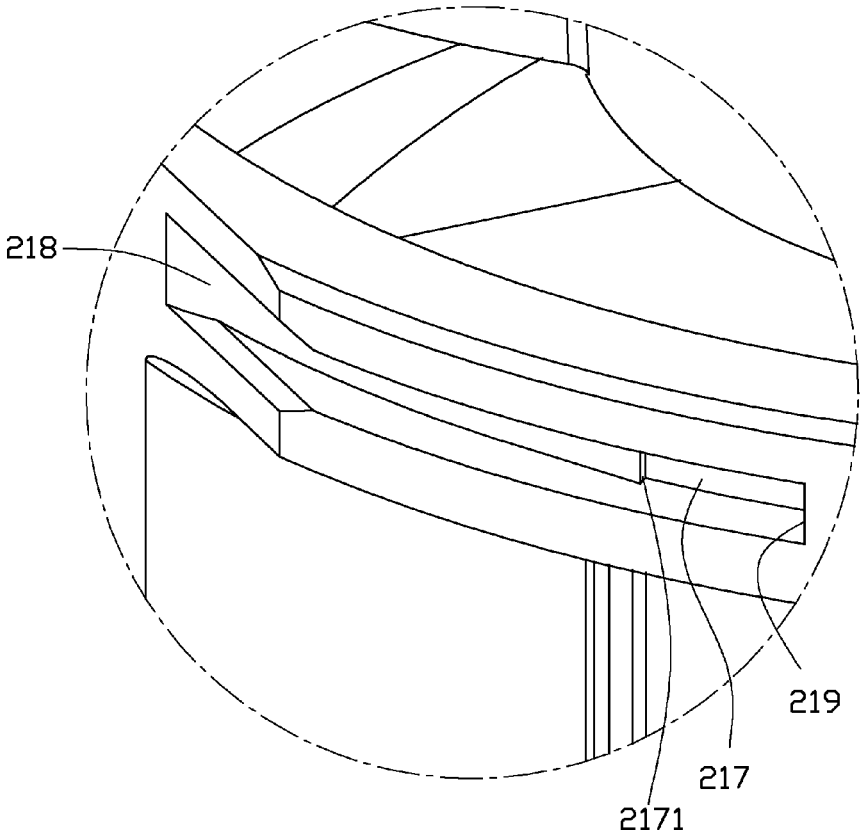
FIG. 4 is an enlarged view of a circled portion IV of FIG. 2.

Also referring to FIG. 4, the second frame 21 includes a second side wall 210. The second side wall 210 is annular. Four flanges 211 extend horizontally and outwardly from a bottom of the second side wall 210. Four curved receiving portions 212 extend horizontally and outwardly from a top of the second side wall 210. Each flange 211 defines a through hole 215. The receiving portions 212 are spaced from each other with a same interval along a circumferential direction of the second side wall 210. The second side wall 210 includes four curved portions 213 and four plane portions 214. The curved portions 213 and the four plane portions 214 are alternately arranged along the circumferential direction of the second side wall 210. Each receiving portion 212 is formed at a top of a corresponding curved portion 213. Each receiving portion 212 defines a guiding groove 218 and a positioning groove 217 communicating with the guiding groove 218. The guiding groove 218 is for guiding the buckling block 117 of the first fan 10 into the positioning groove 217. The positioning groove 217 has a depth larger than that of the guiding groove 218, and a first step 2171 is formed at a joint of the guiding groove 218 and the positioning groove 217. A size and a shape of the buckling block 117 are substantially equal to those of the positioning groove 217. A second step 219 is formed at a distal end of the positioning groove 217 far from the guiding groove 218.

Figure 5:
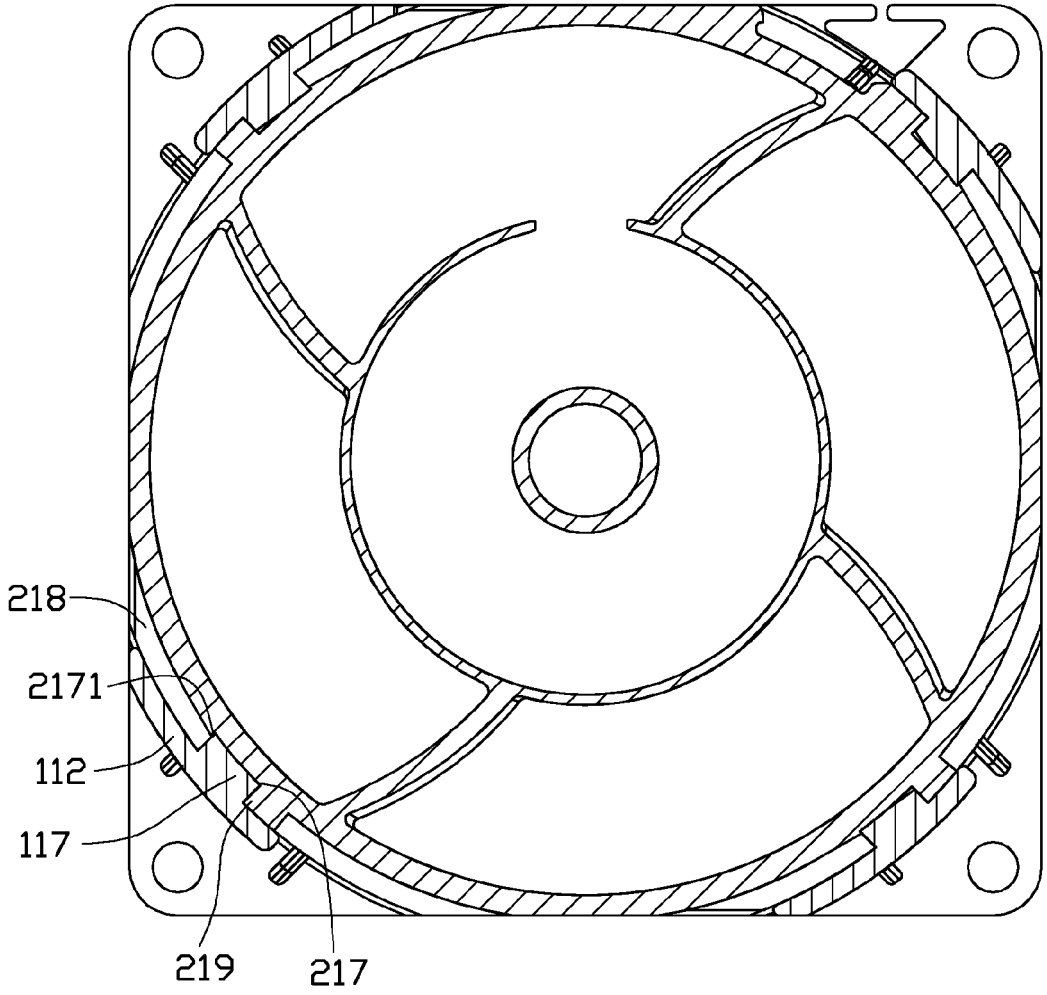
FIG. 5 is a cross sectional view of the fan assembly of FIG. 1, taken along line V-V thereof.

Also referring to FIG. 5, in assembly, the first fan 10 is placed on the second fan 20. The supporting base 12 of the first fan 10 contacts the supporting base 22 of the second fan 20. The extending portions 112 of the first fan 10 are aligned with the plane portions 214 of the second fan 20. The first fan 10 is rotated relative to the second fan 20 to make the buckling blocks 117 move along the guiding grooves 218 into the positioning grooves 217, thereby each the buckling block 117 is buckled between the second step 219 and the first step 2171 at opposite sides of the corresponding positioning groove 217. Meanwhile, the extending portions 112 of the first fan 10 cover and block the guiding grooves 218 and the positioning grooves 217 of the second fan 20, the second step portions 219 abut against the inner side faces of the extending portions 112. Thus, the first and second fans 10, 20 are connected together.

It is believed that the embodiment(s) and its advantages will be understood from the foregoing description, and it will be apparent that various changes may be made thereto without departing from the spirit and scope of the disclosure or sacrificing all of its material advantages, the examples hereinbefore described merely being preferred or exemplary embodiments of the disclosure.

What is claimed is:

1. A fan assembly comprising a first fan and a second fan placed on the first fan, each of the first fan and the second fan comprising a frame, a plurality of extending portions extending from a side of the frame of the first fan, a buckling block being formed on an inner side face of each of the extending portions, a plurality of receiving portions being formed at a side of the frame of the second fan corresponding to the extending portions, respectively, a positioning groove being defined in each of the receiving portions, the buckling blocks being engagingly buckled in the positioning grooves, respectively;

wherein each frame comprises an annular side wall, a plurality of flanges extending horizontally and outwardly from a top of the annular side wall of the first fan, the extending portions extending downwardly beyond a bottom of the annular side wall.

2. The fan assembly of claim 1, wherein each of the receiving portions defines a guiding groove communicating with the positioning groove, when the first fan is rotated relative to the second fan, the buckling blocks moving along the guiding grooves to the positioning grooves.

3. The fan assembly of claim 2, wherein the positioning groove has a depth larger than that of the guiding groove, a first step being formed at a joint of the guiding groove and the positioning groove, a second step being formed at a distal end of the positioning groove far from the guiding groove, the buckling block being buckled between the first step and the second step.

4. The fan assembly of claim 3, wherein the second step abuts against the inner side face of the extending portion.

5. The fan assembly of claim 2, wherein the extending portions of the first fan cover and block the guiding grooves and the positioning grooves of the second fan.

6. The fan assembly of claim 1, wherein the positioning groove has a size and a shape equal to those of the buckling block of the first fan.

7. The fan assembly of claim 1, wherein each of the first fan and the second fan further comprises a supporting base received in the frame, the supporting bases of the first fan and the second fan contacting each other.

8. The fan assembly of claim 7, wherein the supporting base of each of the first fan and the second fan comprises a body, and a plurality of strips extending radially from a periphery of the body, the strips connecting an inner face of the frame.

9. The fan assembly of claim 8, wherein the supporting base of each of the first fan and the second fan further comprises an annular wall extending vertically from a center of the body.

10. The fan assembly of claim 1, wherein the side wall of each of the first fan and the second fan comprises a plurality of curved portions and plane portions, the curved portions and the plane portions being alternately arranged along a circumferential direction of the side wall, each extending portion being formed at a corresponding curved portion of the first fan, each receiving portion being formed at a corresponding curved portion of the second fan.

* * * * *